US008129319B2

(12) United States Patent
Katafuchi et al.

(10) Patent No.: US 8,129,319 B2
(45) Date of Patent: Mar. 6, 2012

(54) LUBRICATING COMPOSITION

(75) Inventors: Tadashi Katafuchi, Chiba (JP); Motoharu Ishikawa, Chiba (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 238 days.

(21) Appl. No.: 11/463,191

(22) Filed: Aug. 8, 2006

(65) Prior Publication Data

US 2007/0049506 A1 Mar. 1, 2007

(30) Foreign Application Priority Data

Aug. 31, 2005 (JP) ..... 2005-252153

(51) Int. Cl.
*C10M 169/04* (2006.01)
*C10M 173/02* (2006.01)

(52) U.S. Cl. ..... 508/491; 508/509

(58) Field of Classification Search ..... 508/491, 508/509

See application file for complete search history.

(56) References Cited

U.S. PATENT DOCUMENTS 2,691,000 A 10/1954 Elliott
3,518,193 A 6/1970 Cyba
4,812,246 A * 3/1989 Yabe ..... 508/364
4,943,303 A * 7/1990 Pialet ..... 44/435
5,141,658 A * 8/1992 DiBiase ..... 508/192
5,705,458 A * 1/1998 Roby et al. ..... 508/445
2005/0043191 A1 * 2/2005 Farng et al. ..... 508/185

FOREIGN PATENT DOCUMENTS

GB 1145189 3/1969
JP 2001288490 A * 10/2001

OTHER PUBLICATIONS

U.S. Appl. No. 11/602,130, filed Nov. 27, 2009, Ito

* cited by examiner

*Primary Examiner* — Walter D Griffin

*Assistant Examiner* — Vishal Vasisth

(74) *Attorney, Agent, or Firm* — Oblon, Spivak, McClelland, Maier & Neustadt, L.L.P.

(57) ABSTRACT

A lubricating composition comprising a base oil, (A) one or more kinds of compounds selected from phenolic antioxidants and aminic antioxidants, and (B) an ester compound having a disulfide structure is provided. The lubricating composition of the present invention has excellent stability against oxidation, prevents increase of acid value and sludge formation, and has low corrosivity to non-ferrous metals.

15 Claims, No Drawings

LUBRICATING COMPOSITION

BACKGROUND OF THE INVENTION

1. Field of the Invention

The present invention relates to a lubricating composition, more specifically, to a lubricating composition which has excellent stability against oxidation, prevents increase of acid value and sludge formation, and also has low corrosivity to non-ferrous metals.

2. Description of the Related Art

Lubricating oil is used in various fields as automobile lubricating oil used for internal combustion engines, driving mechanisms including automatic transmissions, dampers, or power steerings and gears; gear oil or bearing oil for various kinds of machineries and tools; hydraulic oil, which also serves as power transmission fluid on operations such as transmission, control, or damping of power in hydraulic systems of hydraulic apparatuses and devices; metalworking oil used for metalworking including cutting, grinding, or plastic working; and the like. Lubricating grease is also used in the same manner.

These lubricating oil compositions, that is, lubricating oil and grease, inevitably suffer from shortening service life caused by oxidative deterioration with oxygen or NOx, and therefore, they are usually admixed with an antioxidant so as to extend their service life as long as possible.

For example, lubricating oil for internal combustion engines (engine oil) mainly lubricates various sliding parts such as piston rings and cylinder liners, bearings for crankshafts or connecting rods, or valve operating systems involving cams and valve lifters. In addition, engine oil cools inside of engines, diffuses combustion products in it for cleaning and prevents rust and corrosion.

Thus, various kinds of performances are required for engine oil. Moreover, engine oil is recently expected to have still higher performances because internal combustion engines with higher performance and higher output have been developed and operated under more and more harsh conditions. Therefore, in order to satisfy these demands, various kinds of additives such as abrasion inhibitors, metal detergents, ashless dispersants, and antioxidants are admixed in the engine oil.

On the other hand, gas engine heat pump systems and cogeneration systems have been recently developed and commercialized for air-conditioners of houses or buildings. These systems involve gas engines which generally use natural gas, liquefied petroleum gas (LPG) or the like as fuel. However, because maintenance services have increased with popularization of these systems, improvements in maintenance services including simplifying checkout services and prolonging maintenance interval have become a critical issue. There is, thus, a demand for long-life engine oil, which exhibits high resistance against oxidative deterioration and can prolong drain interval.

Incidentally, lubricating oil for gas engine heat pumps, because it experiences a high combustion temperature and for reasons relating to the structure of these equipments, has a problem that it tends to deteriorate rapidly upon contact with NOx which is contained at a high concentration in blow-by gas. Therefore, investigations have been pursued to prolong drain interval of the oil by improving its oxidation stability, particularly oxidation stability against NOx. As methods of improving oxidation stability of lubricating oil, there have been used so far, for example, a method of selecting a base oil or an additive (which is a base material for lubricating oil) excellent in oxidation resistance; a method of selecting an appropriate additive which suppresses effectively oxidative deterioration of the base material; and the like.

As an example of long-life gas engine heat pump engine oil which is excellent in oxidation resistance against NOx and particularly reduces burden of maintenance services, there is disclosed a lubricating composition which contains poly(alkenylsuccinimide) and/or a boron derivative thereof, specific diarylamines, and specific hindered phenols in a given proportion, respectively as described, for example, in Japanese Patent Application Laid-Open No. 7-126681.

Nonetheless, the aforementioned conventional technology still does not provide satisfactory stability against oxidation and the actual situation is that an aimed drain interval has not been attained yet.

As for hydraulic oil, it serves as power transmission fluid used for operations such as transmission, control, or damping of power in hydraulic systems of hydraulic power equipments or devices. The hydraulic oil works also to lubricate sliding parts.

Nowadays, hydraulic power equipments have been progressed along the line of miniaturization and increase in output, being accompanied by still higher operating pressures (for example, an operating pressure of 30 MPa or higher is now used in place of a conventional pressure of 14 MPa to 20 MPa) while the volumes of their oil tanks have become smaller. For this reason, still higher thermal load is applied to actuating shafts, and this causes the problems of early deterioration, sludge formation, abnormal odor, chattering of cylinders, mal-operation, and others.

Conventionally, zinc alkyldithiophosphate (ZnDTP), which works as an antioxidant and a lubricant, has been used for hydraulic oil. However, such hydraulic oil still has the problems of sludge formation, mal-operation caused by this sludge, abnormal odor, and others, because ZnDTP is thermally decomposed at hot sections where the temperature is locally elevated by compression heat of gas bubbles with an increase in pressure.

As an example of hydraulic oil which effectively prevents early deterioration and sludge formation in high pressure operation, has a long service life, and also shows stable performance without chattering of cylinders, there has been proposed a hydraulic oil composition which comprises an aminic antioxidant, a phenolic antioxidant, a phosphate ester, and an aliphatic amide and/or a polyol ester in a specific ratio respectively added to a base oil having a % CA of 5 or less as described, for example, in Japanese Patent Application Laid-Open No. 9-111277.

This hydraulic oil composition is, although its performances are rather improved as compared with conventional oil compositions, still unsatisfactory in performances in long-term service.

Until now, as a part of the study towards extending service life of lubricating oil, development of more effective antioxidants and technology of combinations thereof have been examined. In such technology, ZnDTP has been conventionally used in many cases. ZnDTP not only works as an antioxidant but also has a large effect on abrasion prevention. ZnDTP works as a corrosion inhibitor as well, and has been widely used, particularly for engine oil.

However, recent tightening of the automobile emission regulation has led to installation of exhaust gas cleaning equipments in automobile engines. Lead-free gasoline and low-phosphorus engine oil have been introduced so as to prevent poisoning of the catalyst used in the exhaust gas cleaning equipment. Following this event, use of ZnDTP also has begun to be limited. Therefore, it has become essential to develop phosphorous-free antioxidants.

Conventionally, it is well known that a synergetic effect can be obtained by using a sulfur-based antioxidant and a phenolic antioxidant in combination. As the sulfur-based antioxidant, however, an antioxidant having a monosulfide structure has been mainly used, and there is a problem of increase of acid value caused by hydrolysis. Further, sulfur-based compounds having a trisulfide or higher polysulfide structure have a problem of having a larger corrosivity to non-ferrous metals.

SUMMARY OF THE INVENTION

With the foregoing circumstances in view, the present invention has an object to provide a lubricating composition which has excellent stability against oxidation, prevents increase of acid value and sludge formation and also has low corrosivity to non-ferrous metals.

As a result of intensive studies on developing a lubricating composition having the aforementioned suitable performance, the present inventors have found that a lubricating composition comprising a combination of a phenolic antioxidant and/or an aminic antioxidant and an ester compound having a disulfide structure fulfills the above-mentioned object. This finding has then led to the completion of the present invention.

Namely, the present invention provides:

(1) a lubricating composition comprising a base oil, (A) at least one kind of compound selected from a phenolic antioxidant and an aminic antioxidant, and (B) an ester compound having a disulfide structure;

(2) the lubricating composition described in (1), wherein component (A) and component (B) are contained in an amount of 0.05% to 3.0% by mass respectively;

(3) the lubricating composition described in (1) or (2), wherein the ratio of component (A) to component (B) is 20:80 to 80:20 by mass;

(4) the lubricating composition described in (1) or (2), wherein component (B) is at least one kind of compound selected from a dimer of an alkyl ester of thioglycolic acid (here the alkyl group has 4 to 18 carbon atoms), a dimer of an alkyl ester of mercaptomaleic acid (here the alkyl group has 4 to 18 carbon atoms), a dimer of an alkyl ester of thiosalicylic acid (here the alkyl group has 4 to 18 carbon atoms), and a dimer of an alkyl ester of mercaptopropionic acid (here the alkyl group has 4 to 18 carbon atoms); and (5) the lubricating composition described in (1) or (2), wherein the base oil has a % CA of 3.0 or less as determined with the ring analysis and a sulfur content of 50 ppm by mass or less.

According to the present invention, by admixing a combination of a phenolic antioxidant or an aminic antioxidant and an ester compound having a disulfide structure to a base oil, a lubricating composition can be provided which has excellent stability against oxidation, prevents increase of acid value and sludge formation, and also has low corrosivity to non-ferrous metals.

DESCRIPTION OF THE PREFERRED EMBODIMENTS

As a base oil used for a lubricating composition according to the present invention, used is preferably an oil which has a % CA of 3.0 or less as determined with the ring analysis and a sulfur content of 50 ppm by mass or less. Here, % CA as determined with the ring analysis represents a percentage of aromatic carbon calculated in accordance with the n-d-M ring analysis method. The sulfur content was measured in accordance with JIS K2541.

Using a base oil having a % CA of 3.0 or less and a sulfur content of 50 ppm by mass or less, the effect of the present invention can be well demonstrated and one can obtain a lubricating composition which has excellent stability against oxidation, prevents increase of acid value and sludge formation, and also has low corrosivity to non-ferrous metals. A base oil having a % CA of 1.0 or less more preferably, having a % CA of 0.5 or less and a sulfur content of 10 ppm by mass or less still more preferably is used in the present invention.

As a base oil in the present invention, can be used any oil including mineral oil or synthetic oil which possesses the above-mentioned properties.

As the mineral oil, there may be mentioned, for example, refined mineral oil obtained by processing a lubricating oil fraction, which is obtained by vacuum distillation of a residue resulting from atmospheric distillation of crude oil, through one or more process(es) selected from solvent deasphalting, solvent extraction, hydrocracking, solvent dewaxing, catalytic dewaxing, hydrorefining, and other processes; and mineral oil produced by isomerization of wax.

As the synthetic oil, there may be mentioned, for example, polybutene; polyolefins such as α-olefin homopolymers or copolymers (for example, ethylene/α-olefin copolymer); various kinds of esters such as polyol esters, dibasic acid esters, or phosphate esters; various kinds of ethers such as polyphenylethers; polyglycols; alkylbenzenes; or alkylnaphthalenes. Among these synthetic oils, polyolefins or polyol esters are preferred.

As the base oil in the present invention, the above-mentioned mineral oil can be used solely or two or more kinds in combination. Similarly, the above-mentioned synthetic oil can be used solely or two or more kinds in combination. Further, one or more kinds of the mineral oil and one or more kinds of the synthetic oil can be used in combination.

The viscosity of base oil is not particularly limited, and it can vary according to the use of the lubricating composition. In general, a base oil having a kinematic viscosity of 1 $mm^2/s$ to 500 $mm^2/s$ at 40° C. is used.

In the lubricating composition according to the present invention, in order to obtain a lubricating composition which has excellent stability against oxidation, prevents increase of acid value and sludge formation, and also has low corrosivity to non-ferrous metals, used is a combination of (A) at least one kind of compound(s) selected from phenolic antioxidants and aminic antioxidants and (B) an ester compound having a disulfide structure.

In the aforementioned component (A), there is not particular limitation on the phenolic antioxidant. An appropriate antioxidant can be arbitrarily selected from known phenolic antioxidants which have been so far used as antioxidants for lubricating oil. As such a phenolic antioxidant, there may be mentioned, for example, a monocyclic phenol such as 2,6-di-tert-butyl-4-methylphenyl, 2,6-di-tert-butyl-4-ethylphenol, 2,4,6-tri-tert-butylphenol, 2,6-di-tert-butyl-4-hydroxymethylphenol, 2,6-di-tert-butylphenol, 2,4-dimethyl-6-tert-butylphenol, 2,6-di-tert-butyl-4-(N,N-dimethylaminomethyl) phenol, 2,6-di-tert-amyl-4-methylphenol or n-octadecyl 3-(4-hydroxy-3,5-di-tert-butylphenyl)propionate; and a polycyclic phenol such as 4,4'-methylenebis(2,6-di-tert-butylphenol), 4,4'-isopropylidenebis(2,6-di-tert-butylphenol), 2,2'-methylenebis(4-methyl-6-tert-butylphenol), 4,4'-bis(2,6-di-tert-butylphenol), 4,4'-bis(2-methyl-6-tert-butylphenol), 2,2'-methylenebis(4-ethyl-6-tert-butylphenol), 4,4'-butylidenebis(3-methyl-6-tert-butylphenol), 2,2'-thiobis(4-methyl-6-tert-butylphenol) or 4,4'-thiobis(3-methyl-6-tert-butylphenol). Among these phenols, monocyclic phenols are preferred from the viewpoint of effectiveness.

In the aforementioned component (A), there is not particular limitation on the aminic antioxidant. An appropriate antioxidant can be arbitrarily selected from known aminic antioxidants which have been so far used as antioxidants for lubricating oil. As such an aminic antioxidant, there may be mentioned, for example, diphenylamines such as diphenylamine or alkylated diphenylamines having alkyl group(s) with 3 to 20 carbon atoms, including monooctyldiphenylamine, monononyldiphenylamine, 4,4'-dibutyldiphenylamine, 4,4'-dihexyldiphenylamine, 4,4'-dioctyldiphenylamine, 4,4'-dinonyldiphenylamine, tetrabutyldiphenylamine, tetrahexyldiphenylamine, tetraoctyldiphenylamine, and tetranonyldiphenylamine; or naphthylamines such as α-naphthylamine, phenyl-α-naphthylamine, or phenyl-α-naphthylamines substituted with alkyl group(s) having 3 to 20 carbon atoms, including butylphenyl-α-naphthylamine, hexylphenyl-α-naphthylamine, octylphenyl-α-naphthylamine, and nonylphenyl-α-naphthylamine. Among these compounds, diphenylamines are more suitable than naphthylamines from the viewpoint of effectiveness. Particularly, alkylated diphenylamines wherein each alkyl group has 3 to 20 carbon atoms, especially, 4,4'-di($C_3$ to $C_{20}$ alkyl) diphenylamines are preferred.

In the present invention, the above-mentioned phenolic antioxidants can be used as component (A) solely or two or more kinds in combination. Similarly, the above-mentioned aminic antioxidants can be used solely or two or more kinds in combination. Further, one or more kinds of the phenolic antioxidants and one or more kinds of the aminic antioxidants can be used in combination.

In the present invention, the content of component (A) is, in view of balance between effects and economical efficiency, preferably 0.05% to 3.0% by mass, more preferably 0.1% to 2.0% by mass based on the total amount of the lubricating composition.

As the ester compound having a disulfide structure, component (B), for example, a compound represented by general formula (I) can be used:

$$(R^1OOC)_n\text{-}A^1\text{-}S\text{—}S\text{-}A^2\text{-}(COOR^2)_m \quad \text{(I)},$$

wherein $R^1$ and $R^2$ represent independently hydrocarbyl groups having 1 to 30 carbon atoms; $A^1$ and $A^2$ represent independently divalent or trivalent hydrocarbon groups; m and n represent independently 1 or 2.

In the above-mentioned general formula (I), the hydrocarbyl groups having 1 to 30 carbon atoms represented by $R^1$ and $R^2$ are hydrocarbyl groups having preferably 1 to 20, more preferably 2 to 18, particularly preferably 4 to 18 carbon atoms. The hydrocarbyl groups may be straight chain, branched chain, or cyclic, and may contain oxygen atom(s), sulfur atom(s), or nitrogen atom(s). Here $R^1$ and $R^2$ may be different or the same with each other, but they are preferably the same for the convenience in production.

In the above-mentioned hydrocarbyl groups, alkyl groups having 4 to 18 carbon atoms are particularly suitable. Specifically, there may be mentioned various isomeric forms of butyl, hexyl, octyl, decyl, dodecyl, tetradecyl, hexadecyl, octadecyl groups, or the like.

As the divalent or trivalent hydrocarbon groups represented by $A^1$ and $A^2$, there may be mentioned an alkylene, alkanetriyl, alkenylene, or alkenetriyl group having preferably 1 to 10, more preferably 1 to 6, carbon atoms; an arylene group having 6 to 10 carbon atoms; and the like. These divalent or trivalent hydrocarbon groups, in the case of aliphalic groups, may be straight chain, branched chain, or cyclic. In addition, $A^1$ and $A^2$ may be different or the same with each other, but they are preferably the same for the convenience in production.

Further, when n is 2, the two $COOR^1$ groups may be different or the same, but they are preferably the same for the convenience in production. When m is 2, the two $COOR^2$ groups can be different or the same, but they are preferably the same for the convenience in production.

As the compound represented by the above-described general formula (I), there may be mentioned, for example, a dimer of an alkyl ester of thioglycolic acid (here the alkyl group has 4 to 18 carbon atoms), a dimer of an alkyl ester of mercaptomaleic acid (here the alkyl group has 4 to 18 carbon atoms), a dimer of an alkyl ester of thiosalicylic acid (here the alkyl group has 4 to 18 carbon atoms), and a dimer of an alkyl ester of mercaptopropionic acid (here the alkyl group has 4 to 18 carbon atoms).

In the present invention, the above-described ester compounds having a disulfide structure may be used as component (B) solely or two or more kinds in combination. The content of component (B) is, in view of balance between effects and economical efficiency, preferably 0.05% to 3.0% by mass, more preferably 0.1% to 2.0% by mass based on the total amount of the lubricating composition.

In the lubricating composition according to the present invention, in order to demonstrate the effect of the present invention sufficiently, the mass ratio of component (A) to component (B) is selected preferably from the range of 20:80 to 80:20, more preferably 30:70 to 70:30.

If an ester compound having a monosulfide structure is used for a lubricating composition in place of the above-described ester compound having a disulfide structure, component (B), there might be a problem of increase of acid value caused by hydrolysis. Further, when an ester compound having a trisulfide or higher polysulfide structure, the resultant lubricating composition is prone to be more corrosive to non-ferrous metals.

The lubricating composition according to the present invention has no particular limitation for its use. For example, the lubricating composition can be used as: automobile lubricating oil for internal combustion engines, driving mechanisms such as automatic transmissions, dampers or power steering, or gears; gear oil or bearing oil for various kinds of machineries and tools; or lubricating oil such as hydraulic oil which serves as power transmission fluid used for operations such as transmission, control, or damping of power in hydraulic systems of hydraulic power equipments or devices; or grease for various purposes.

The lubricating composition according to the present invention may contain various kinds of additives appropriate for each purpose, for example, friction modifiers including oiliness agents and extreme-pressure additives, antiwear agents, ashless dispersants, metal detergents, viscosity index improvers, pour-point depressants, rust preventives, metal corrosion inhibitors, antifoaming agents, or surfactants.

As the friction modifier or antiwear additive, there may be mentioned, for example, sulfur-containing compounds such as sulfurized olefins, dialkylpolysulfides, diarylalkylpolysulfides or diarylpolysulfides; phosphorus-containing compounds such as phosphate esters, thiophosphate esters, phosphite esters, alkyl hydrogenphosphites, amine salts of phosphate esters, or amine salts of phosphite esters; chlorine-containing compounds such as chlorinated oil, chlorinated paraffins, chlorinated fatty acid esters, or chlorinated fatty acids; ester compounds such as alkyl or alkenyl maleates or alkyl or alkenyl succinates; organic acids such as alkyl- or alkenyl-substituted maleic acids or alkyl- or alkenyl-substituted succinic acids; naphthenate salts; or organometallic compounds such as zinc alkyldithiophosphate (ZnDTP), zinc dithiocarbamate (ZnDTC), molybdenum(VI) oxysulfide organophosphorodithioate (MoDTP), or molybdenum(VI) oxysulfide dithiocarbamate (MoDTC).

As the ashless dispersant, there may be mentioned, for example, succinimides, boron-containing succinimides, benzylamines, boron-containing benzylamines, succinate esters, and amides of mono- or di-carboxylic acids represented by a fatty acid or succinic acid, respectively. As the metal detergent, there may be mentioned, for example, neutral metal sulfonates, neutral metal phenates, neural metal salicylates, neutral metal phosphonates, basic sulfonates, basic phenates, basic salicylates, basic phosphonates, overbasic sulfonates, overbasic phenates, overbasic salicylates, and overbasic phosphonates.

As the viscosity index improver, there may be mentioned, for example, polymethacrylate, dispersing polymethacrylate, olefin-based copolymers such as ethylene/propylene copolymer, dispersing olefin-based copolymers, and styrene-based copolymers such as hydrogenated styrene/diene copolymer. As the pour point depressant, there may be mentioned, for example, polymethacrylate.

As the rust preventive, for example, alkenyl succinic acids or partial esters thereof may be used. As the metal corrosion inhibitors, there may be used, for example, benzotriazoles, benzimidazoles, benzothiazoles and thiadiazoles. As the antifoaming agent, for example, dimethylpolysiloxane or polyacrylate may be used. As the surfactant, for example, polyoxyethylene alkylphenyl ether may be used.

The lubricating composition according to the present invention has such advantages of having excellent stability against oxidation, preventing increase of acid value and sludge formation, and having low corrosivity to non-ferrous metals. The lubricating composition is used suitably for, particularly, engine oil, lubricating oil for gas engine heat pumps, lubricating oil for automatic transmissions and traction drive continuously variable transmissions, or hydraulic oil.

EXAMPLES

The present invention will be described in more detail with the following examples, but it should be construed that the present invention is in no way limited to those examples.

The properties and characteristics of the lubricating composition obtained in each example were evaluated in accordance with the methods described below.

<Properties of Lubricating Composition:>

(1) Kinematic viscosity was measured in accordance with "Determination of kinematic viscosity for petroleum products" as defined by JIS K2283;

(2) Viscosity index was measured in accordance with "Determination of viscosity index for petroleum products" as defined by JIS K2283;

(3) Acid value was measured by potentiometry in accordance with "Determination of neutralization number for lubricants" as defined by JIS K2501;

(4) Sulfur content was measured in accordance with JIS K2541:

<Characteristics of Lubricating Composition:>

(5) NOx deterioration test:

the following characteristics were evaluated, using an ISOT testing machine, with bubbling nitrogen gas containing 8000 ppm (by volume) of NO at a flow rate of 100 mL/min and air at a flow rate of 100 mL/min into a sample oil in the presence of copper and iron catalysts; the testing temperature was 140° C. and the testing period was 96 hr;

(a) Kinematic viscosity ratio (40° C.) was calculated in accordance with the relation of kinematic viscosity ratio (40° C.)=(40° C. kinematic viscosity of oil after test)/(40° C. kinematic viscosity of oil before test);

(b) Acid value increase was calculated in accordance with the relation of acid value increase=(acid value of oil after test)−(acid value of oil before test);

(c) NOx deterioration index: IR spectra of oil before and after test were recorded with a cell having an optical path length of 0.1 mm, and the absorbance difference at a wave number of 1630 $cm^{-1}$, that is, (absorbance of oil after test)−(absorbance of oil before test) refers to NOx deterioration index;

(d) Oxidative deterioration index: IR spectra of oil before and after test were recorded with a cell having an optical path length of 0.1 mm, and the absorbance difference at a wave number of 1710 $cm^{-1}$, that is, (absorbance of oil after test)−(absorbance of oil before test) refers to oxidation deterioration index;

(e) Cu content in the oil after test was determined with the ICP emission analysis;

Examples 1 to 6 and Comparative Examples 1 to 5

Lubricating compositions were prepared, whose compositions are given in Table 1 and Table 2. The properties of each lubricating composition are also given in Table 1.

Then, each lubricating composition was subjected to the NOx deterioration test at 140° C. for 96 hr, and its characteristics were evaluated. The results are also given in Table 1 and Table 2.

TABLE 1

| | | | Examples | | | | | |
|---|---|---|---|---|---|---|---|---|
| | | | 1 | 2 | 3 | 4 | 5 | 6 |
| Lubricating compositions | Compositions (% by mass) | Base oil | 98.866 | 98.866 | 98.366 | 98.866 | 98.672 | 98.335 |
| | | Ph-AO | 0.500 | — | 0.500 | 0.250 | 0.500 | 0.500 |
| | | Am-AO | — | 0.500 | 0.500 | 0.250 | — | — |
| | | DS-AO-1 | 0.634 | 0.634 | 0.634 | 0.634 | — | — |
| | | DS-AO-2 | — | — | — | — | 0.828 | — |
| | | DS-AO-3 | — | — | — | — | — | 1.165 |
| | Properties | 40° C. Kinematic viscosity ($mm^2/s$) | 89.27 | 88.93 | 88.80 | 89.11 | 91.65 | 89.35 |
| | | 100° C. Kinematic viscosity ($mm^2/s$) | 10.800 | 10.690 | 10.670 | 10.700 | 10.940 | 10.810 |
| | | Viscosity index | 105 | 104 | 103 | 104 | 104 | 105 |
| | | Acid value (mgKOH/g) | 0.04 | 0.03 | 0.14 | 0.13 | 0.01 | 0.04 |
| | | S content (% by mass) | 0.10 | 0.10 | 0.10 | 0.11 | 0.11 | 0.11 |

TABLE 1-continued

| | | Examples | | | | | |
|---|---|---|---|---|---|---|---|
| | | 1 | 2 | 3 | 4 | 5 | 6 |
| NOx deterioration test (140° C., 96 hr) | Kinematic viscosity ratio at 40° C. | 1.20 | 1.16 | 1.12 | 1.17 | 1.11 | 1.30 |
| | Acid value increase (mgKOH/g) | 3.52 | 4.44 | 1.72 | 2.78 | 3.52 | 4.38 |
| | NOx deterioration index | 0.621 | 0.482 | 0.351 | 0.549 | 0.398 | 0.710 |
| | Oxidative deterioration index | 0.331 | 0.199 | 0.161 | 0.258 | 0.151 | 0.449 |
| | Cu content (ppm by mass) | 92 | 97 | 92 | 27 | 2> | 13 |

Footnotes:
1) base oil: paraffin-based oil, % CA = 0, S content = 10 ppm by mass
2) Ph-AO: n-octadecyl 3-(4-hydroxy-3,5-di-tert-butylphenyl)propionate
3) Am-AO: 4,4'-dioctyldiphenylamine
4) DS-AO-1: dimer of n-octyl thioglycolate
5) DS-AO-2: dimer of n-octyl thiosalicylate
6) DS-AO-3: dimer of di-n-octyl mercaptomaleate

TABLE 2

| | | | Comparative examples | | | | |
|---|---|---|---|---|---|---|---|
| | | | 1 | 2 | 3 | 4 | 5 |
| Lubricating compositions | Compositions (% by mass) | Base oil | 99.500 | 99.500 | 99.000 | 99.500 | 99.366 |
| | | Ph-AO | 0.500 | — | 0.500 | 0.250 | — |
| | | Am-AO | — | 0.500 | 0.500 | 0.250 | — |
| | | DS-AO-1 | — | — | — | — | 0.634 |
| | | DS-AO-2 | — | — | — | — | — |
| | | DS-AO-3 | — | — | — | — | — |
| | Properties | 40° C. Kinematic viscosity ($mm^2/s$) | 91.42 | 91.20 | 91.03 | 91.25 | 88.57 |
| | | 100° C. kinematic viscosity ($mm^2/s$) | 10.930 | 10.820 | 10.810 | 10.840 | 10.680 |
| | | Viscosity index | 104 | 103 | 103 | 103 | 104 |
| | | Acid value (mgKOH/g) | 0.02 | 0.03 | 0.03 | 0.03 | 0.05 |
| | | S content (% by mass) | 0.00 | 0.00 | 0.00 | 0.00 | 0.11 |
| NOx deterioration test (140° C., 96 hr) | Kinematic viscosity ratio at 40° C. | | 3.81 | 3.09 | 2.86 | 3.55 | 1.36 |
| | Acid value increase (mgKOH/g) | | 13.78 | 12.47 | 11.57 | 12.47 | 5.62 |
| | NOx deterioration index | | 1.202 | 1.263 | 1.466 | 1.351 | 0.596 |
| | Oxidative deterioration index | | 1.677 | 1.805 | 1.724 | 1.802 | 0.494 |
| | Cu content (ppm by mass) | | — | — | — | — | — |

Footnotes:
The footnotes on base oil, Ph-AO, Am-AO, DS-AO-1, DS-AO-2, and DA-AO-3 are the same as in Table 1.

As is apparent from Table 1 and Table 2, the lubricating compositions according to the present invention, described in Examples 1 to 6, wherein a phenolic antioxidant or an aminic antioxidant and an ester compound having a disulfide structure are used in combination, exhibit lower kinematic viscosity ratios, lower increases of acid value, and lower oxidative deterioration indexes as compared with the lubricating compositions, described in Comparative examples 1 to 5, wherein a phenolic antioxidant or an aminic antioxidant is used solely or an ester compound having a disulfide structure is used solely. Further, the lubricating compositions described in Examples 1 to 5 exhibit lower NOx deterioration indexes as compared with those described in Comparative examples 1 to 5.

What is claimed is:

1. A lubricating composition comprising:

a base oil;

a phenolic antioxidant;

an aminic antioxidant; and an ester compound having a disulfide structure according to the following general formula (I):

$$(R^1OOC)_n\text{-}A^1\text{-}S\text{—}S\text{-}A^2\text{-}(COOR^2)_m \quad (I)$$

wherein $R^1$ and $R^2$ each independently represent a hydrocarbyl group having 1-30 carbon atoms;

$A^1$ and $A^2$ each independently represent a divalent or trivalent hydrocarbon group; and m and n each independently represent 1 or 2, wherein the base oil has a sulfur content of 50 ppm by weight or less, a % CA of 3.0 or less as determined by ring analysis, and a kinematic viscosity of 1-500 $mm^2/s$ at 40° C., wherein the phenolic antioxidant is selected from the group consisting of a monocyclic phenol and a biscyclic phenol, wherein the aminic antioxidant is a dialkyldiphenylamine, wherein the ester compound having a disulfide structure according to the general formula (I) is present in an amount of 0.05-3.0 wt. %, based on a total weight of the lubricating composition, wherein the ester compound having a disulfide structure according to the general formula (I) includes one or more ester compounds selected from the group consisting of: a dimer of an alkyl ester of thioglycolic acid, wherein the alkyl group has 4-18 carbon atoms; a dimer of an alkyl ester of mercaptomaleic acid, wherein the alkyl group has 4-18 carbon atoms; a dimer of an alkyl ester of thiosalicylic acid, wherein the alkyl group has 4-18 carbon atoms; and a dimer of an alkyl ester of mercaptopropionic acid, wherein the alkyl group has 4-18 carbon atoms, and wherein a weight ratio of the phenolic and aminic antioxidants to the ester compound having a disulfide structure according to the general formula (I) is 20-80:80-20.

2. The lubricating composition according to claim 1, wherein each of m and n is 1.

3. The lubricating composition according to claim 1, wherein the base oil has a sulfur content of 10 ppm by weight or less and a % CA of 1.0 or less as determined by ring analysis.

4. The lubricating composition according to claim 1, wherein the base oil is one or more mineral oils.

5. The lubricating composition according to claim 1, wherein the base oil is one or more synthetic oils.

6. The lubricating composition according to claim 1, wherein the base oil is a combination of one or more mineral oils and one or more synthetic oils.

7. The lubricating composition according to claim 1, wherein the antioxidant compound is present in an amount of 0.05-3.0 wt. % based on the total weight of the lubricating composition.

8. The lubricating composition according to claim 1, wherein the antioxidant compound is present in an amount of 0.1-2.0 wt. % based on the total weight of the lubricating composition.

9. The lubricating composition according to claim 1, wherein the ester compound having a disulfide structure according to the general formula (I) is present in an amount of 0.1-2.0 wt. % based on the total weight of the lubricating composition.

10. The lubricating composition according to claim 1, wherein two or more ester compounds having a disulfide structure according to the general formula (I) are present.

11. The lubricating composition according to claim 1, wherein a weight ratio of the antioxidant compound to the ester compound having a disulfide structure according to the general formula (I) is 30-70:70-30.

12. The lubricating composition according to claim 1, wherein the lubricating composition comprises one or more additives selected from the group consisting of friction modifiers, antiwear agents, ashless dispersants, metal detergents, viscosity index improvers, pour-point depressants, antifoaming agents, surfactants, rust preventives and metal corrosion inhibitors.

13. The lubricating composition according to claim 1, wherein at least one of m and n is 2.

14. The lubricating composition according to claim 1, wherein each of m and n is 2.

15. A lubricating composition comprising:

a base oil;

a phenolic antioxidant;

an aminic antioxidant; and an ester compound having a disulfide structure according to the following general formula (I):

$$(R^1OOC)_n\text{-}A^1\text{-}S\text{—}S\text{-}A^2\text{-}(COOR^2)_m \quad (I)$$

wherein $R^1$ and $R^2$ each independently represent a hydrocarbyl group having 1-30 carbon atoms;

$A^1$ and $A^2$ each independently represent a divalent or trivalent hydrocarbon group; and m and n each independently represent 1 or 2, wherein the base oil has a sulfur content of 50 ppm by weight or less, a % CA of 3.0 or less as determined by ring analysis, and a kinematic viscosity of 1-500 $mm^2/s$ at 40° C., wherein the phenolic antioxidant is selected from the group consisting of a monocyclic phenol and a biscyclic phenol, wherein the aminic antioxidant is a dialkyldiphenylamine, wherein the phenolic antioxidant and the aminic antioxidant are present in a combined amount of 0.05-3.0 wt. %, based on a total weight of the lubricating composition, wherein the ester compound having a disulfide structure according to the general formula (I) is present in an amount of 0.05-3.0 wt. %, based on the total weight of the lubricating composition, wherein the ester compound having a disulfide structure according to the general formula (I) includes one or more ester compounds selected from the group consisting of: a dimer of an alkyl ester of thioglycolic acid, wherein the alkyl group has 4-18 carbon atoms; a dimer of an alkyl ester of mercaptomaleic acid, wherein the alkyl group has 4-18 carbon atoms; a dimer of an alkyl ester of thiosalicylic acid, wherein the alkyl group has 4-18 carbon atoms; and a dimer of an alkyl ester of mercaptopropionic acid, wherein the alkyl group has 4-18 carbon atoms, and wherein a weight ratio of the phenolic and aminic antioxidants to the ester compound having a disulfide structure according to the general formula (I) is 20-80:80-20.

* * * * *